United States Patent [19]

Martin et al.

[11] 4,091,707

[45] May 30, 1978

[54] COMPACT CHORD ORGAN

[75] Inventors: Harold B. Martin, West Caldwell; Herman O. Rogg, Watchung, both of N.J.

[73] Assignee: Graber-Rogg, Inc., Cranford, N.J.

[21] Appl. No.: 642,720

[22] Filed: Dec. 22, 1975

[51] Int. Cl.[2] ..... G10C 3/12

[52] U.S. Cl. ..... 84/423; 84/433; 84/438

[58] Field of Search ..... 84/438, 423, 433, 452 P

[56] References Cited

U.S. PATENT DOCUMENTS

| | | | |
|---|---|---|---|
| 2,844,065 | 7/1958 | Corwin | 84/433 |
| 3,032,455 | 5/1962 | Fauser | 84/433 |
| 3,205,754 | 9/1965 | Beiwar | 84/433 |
| 3,740,448 | 6/1973 | Olszowka et al. | 84/423 |
| 3,855,894 | 12/1974 | Thomas et al. | 84/433 |

FOREIGN PATENT DOCUMENTS

| | | | |
|---|---|---|---|
| 732,808 | 4/1966 | Canada | 84/438 |

*Primary Examiner*—Stephen J. Tomsky

[57] ABSTRACT

A compact chord organ which includes a unitary molded lower chamber portion and an upper chamber portion provided with integrally molded reed housings are pressed together to form a chamber. A volume control together with a treble keyboard and chord keyboards are cooperatively associated with the upper chamber portion and the keys of said keyboards are connected thereto by unitary resilient holding means. A unitary molded cabinet top is pressed together with the upper chamber portion so as to provide a housing for the volume control and pallet ends of the keys.

4 Claims, 8 Drawing Figures

FIG. 1
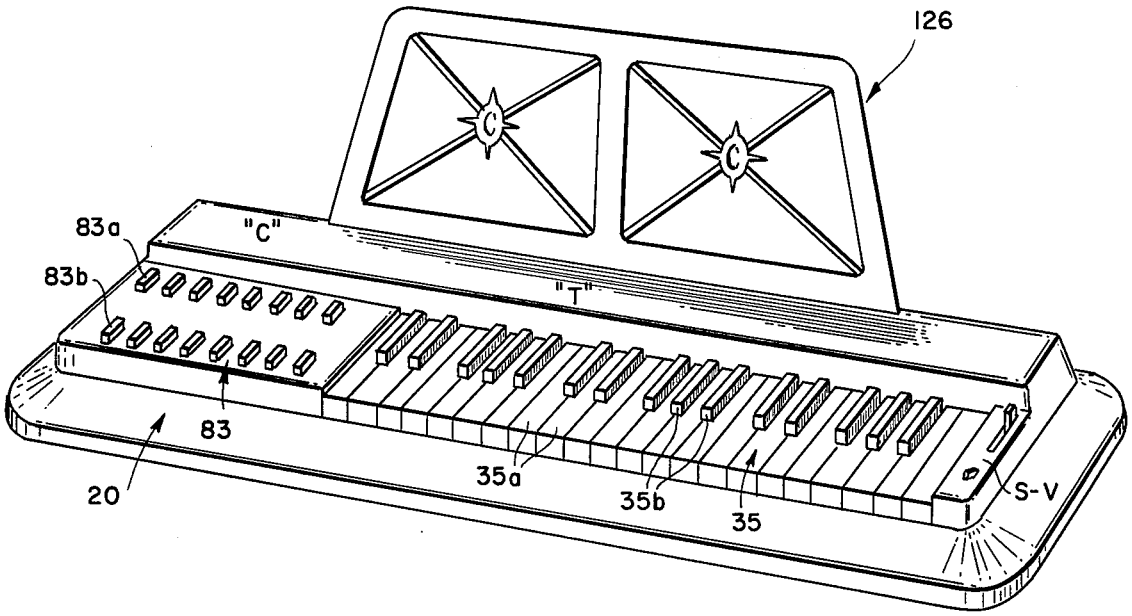
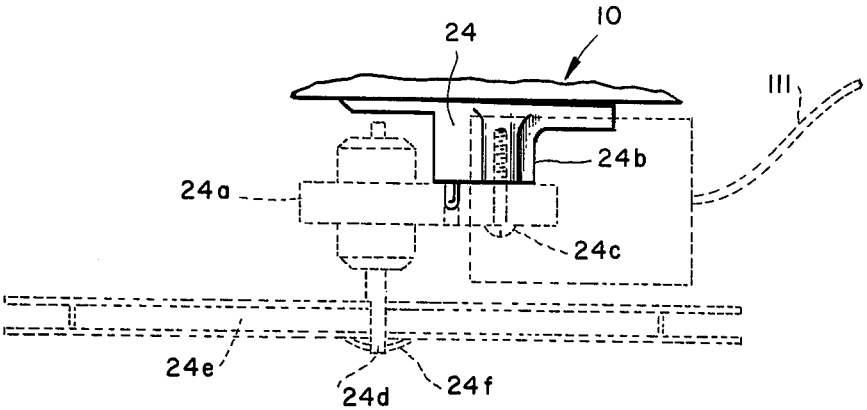
FIG. 5

COMPACT CHORD ORGAN

BACKGROUND OF THE INVENTION

This invention relates to musical instruments, and more particularly to an improved compact chord organ.

It is well known that chord organs include a treble keyboard section typically having two, three or more octaves, and a chord keyboard section typically having eight or 16 chords. Each of the keyboard sections have reed assemblies which include a plurality of openings that are normally closed by extending pallets of keys operative by a user. Each of the reed assembly openings have channels which communicate with respective reeds of varying lengths and thicknesses. When a key is depressed to lift its pallet from an opening, pressurized air is permitted to pass through the reed and exit through the reed assembly opening, thereby causing the desired note to be sounded.

Heretofore, in the mass production of chord organs, numerous components were provided which not only were costly to fabricate but also required much labor time to assemble. Further, with the employment of such numerous components, air losses were prevalent and resulted in the employment of more powerful motors requiring increased power. Accordingly, more material was essential in order to provide strength and stability to the organ. As a result of the foregoing, the costs of manufacture were high and warehouse space was wasted.

Further, in the prior art, the components utilized in the assembly of a chord organ included reed housings, chambers, reed boxes for connection to the chambers, reed plates, individual keys which had to be manually assembled with respect to the reed housings, means for securing the keys,, numerous joints associated with the organ components which required adhesive and sealing means, and various other components, many of which were metallic. The total weight of all the components in one typical model organ approximated 19 pounds and took more than 20 minutes for the manual assembly thereof as compared to a similar model organ of the present invention which weighed approximately 5½ pounds and required approximately 6 minutes assembly time.

SUMMARY OF THE INVENTION

It is an object of this invention to obviate the numerous individual components required in the assembly of a musical keyboard instrument and to provide a compact musical keyboard instrument which is light-weight, requires little assembly time and has little, if any, air losses.

Broadly, the compact musical keyboard instrument of this invention includes a unitary molded lower chamber portion, a unitary molded upper chamber portion and means cooperatively associated with the lower and upper chamber portions for connecting said chamber portions together. A treble keyboard, chord keyboard and volume control are located on the upper chamber portion. A unitary molded cabinet top is provided for housing the pellets of the keys of the treble and chord keyboards, and for housing the volume control. Means are cooperatively associated with the cabinet top and upper chamber portion for connecting the cabinet top to the upper chamber portion.

It is another object of this invention to provide, in the manufacture of a musical keyboard instrument, a unitary molded musical keyboard which includes a plurality of keys molded in a predetermined spacial relationship with respect to each other, and at least one removably connected molded runner attached to the keys for holding the keys in said predetermined spacial relationship.

It is another object of this invention to provide, in the manufacture of a musical keyboard instrument having a reed tonal opening, a key, which includes a unitary molded body having a deformable pallet end portion extending angularly downwards from the body towards the free end thereof for contact with one end portion of the tonal opening, and a cavity located on the body near the other end of the pallet and for receiving a pressure applying member thereon which causes the other end to deform and contact the other end portion of the tonal opening.

It is another object of this invention to provide, in the manufacture of a musical keyboard instrument, a unitary resilient strip cooperatively associated with the instrument keys. The strip includes a longitudinally extending body having a plurality of leg portions integrally extending from the body for receipt in a holding means provided on the housing, and a plurality of fingers integral with an angularly extending from the body for contact with the pallet ends thereof in contact with provided reed tonal openings.

It is a further object of this invention to provide, in the manufacture of a musical keyboard instrument, a unitary gasket which includes a plastic body having a plurality of openings therein, the body being of a uniform thickness and capable of being stretched over the tonal openings such that the openings of the gasket envelop the tonal openings uniformly.

Finally, it is another object of this invention to provide, in a molded chord organ, an upper chamber portion and a lower chamber portion pressed together to form a chamber. The upper chamber portion has integrally connected thereto a plurality of treble and chord openings for a treble keyboard and chord keyboard respectively, the openings extending through the chamber portion and forming respective combs on the bottom surface thereof.

DRAWINGS

FIG. 1 is an isometric view of the assembled musical keyboard instrument;

FIG. 5 is a side view of the motor mount shown with the motor assembly, in phantom, for clarity, connected to the upper chamber portion;

DESCRIPTION OF THE PREFERRED EMBODIMENT

Figure 2:
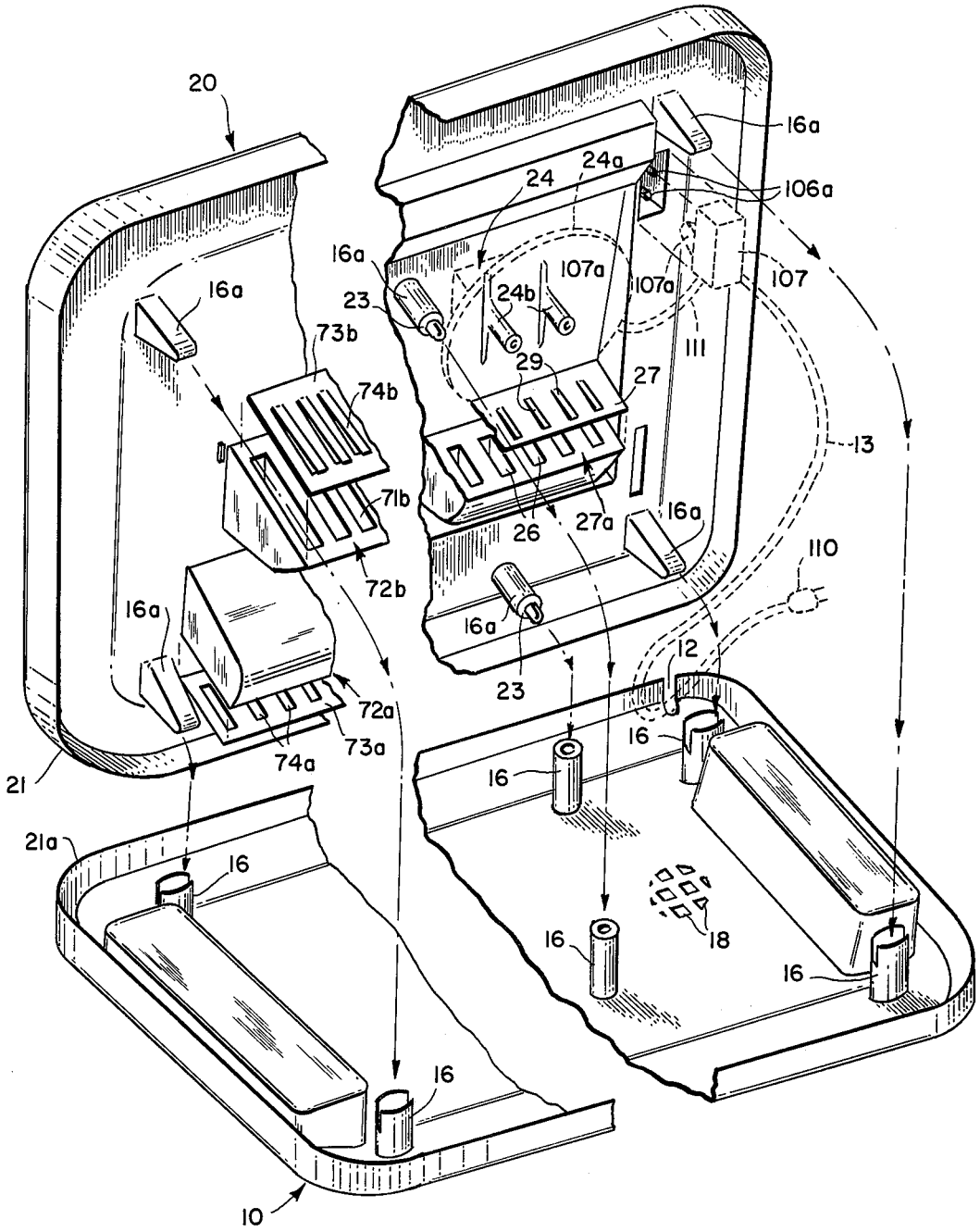
FIG. 2 is a cut-away exploded view of the lower chamber portion and bottom surface of the upper chamber portion.
Figure 4:
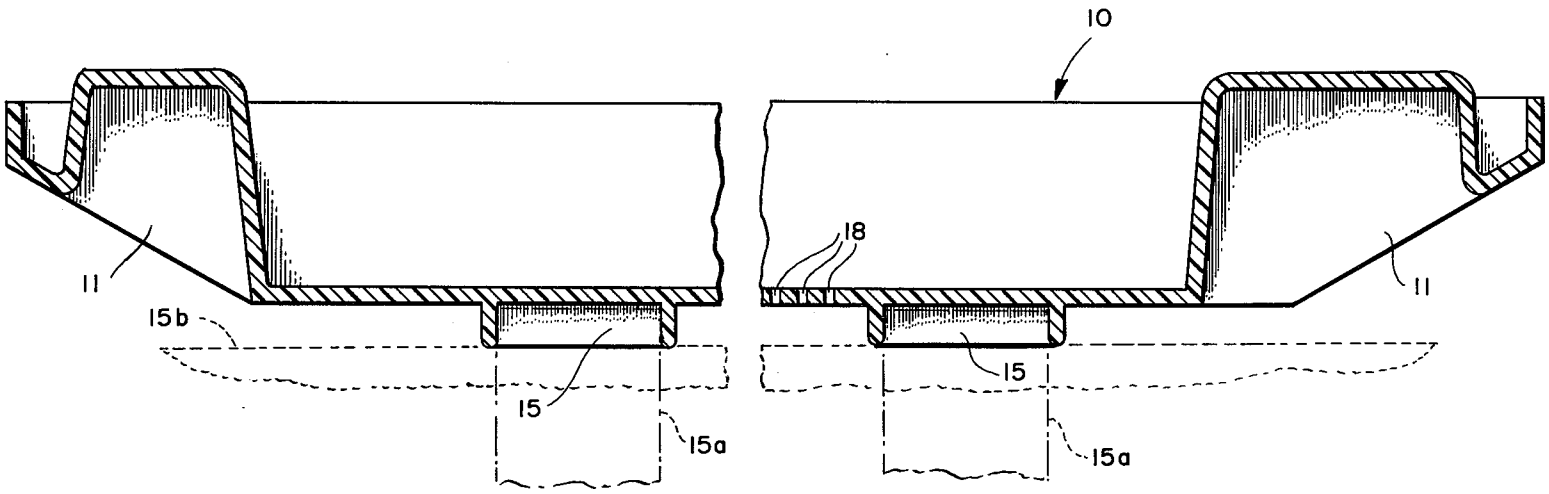
FIG. 4 is a cut-away view and cross-sectional view of the lower chamber portion.

With reference to the drawing, FIGS. 2 and 4 depict a molded cabinet lower chamber portion 10 which may be made from any type plastic material, such as polystyrene. The outer surface of the lower chamber portion 10 is provided with similar recesses 11—11 located on each far end thereof for receiving the fingers of a person to grip the housing for easy movement of the organ from one location to another. One of the recesses is positioned near a slot 12 through which a wire cord 13 passes from the inner surface of the lower chamber portion 10, said wire being compactly wrapped and located in one of the recesses 11 so as to facilitate packaging of the organ for shipment. Also located on the outer surface of lower chamber portion 10 are a pair of recessed locators 15—15, each of which are positioned adjacent to recess 11 for snugly receiving supporting legs (depicted in phantom as 15*a*—15*a*) to support the organ in a standing or upright position. The walls of the locators 15—15 project from the aforesaid outer surface chamber for contact with any desired horizontal surface, such as a table (depicted in phantom as 15*b*) upon which the organ may rest in a stable and level position for play by an operator. The locators 15—15 project a sufficient distance from the table to permit air to be drawn through air intake passage 18 which extends through lower chamber portion 10 for permitting air to be drawn into a chamber to be formed, as described hereinafter. The inner surface of lower chamber portion 10 is provided with a plurality of tubular sockets 16—16 projecting upwardly therefrom. Preferably, the inner diameter of each socket opening 16 is relatively larger near its free end than the inner diameter of the remainder of the socket opening.

Figure 3:
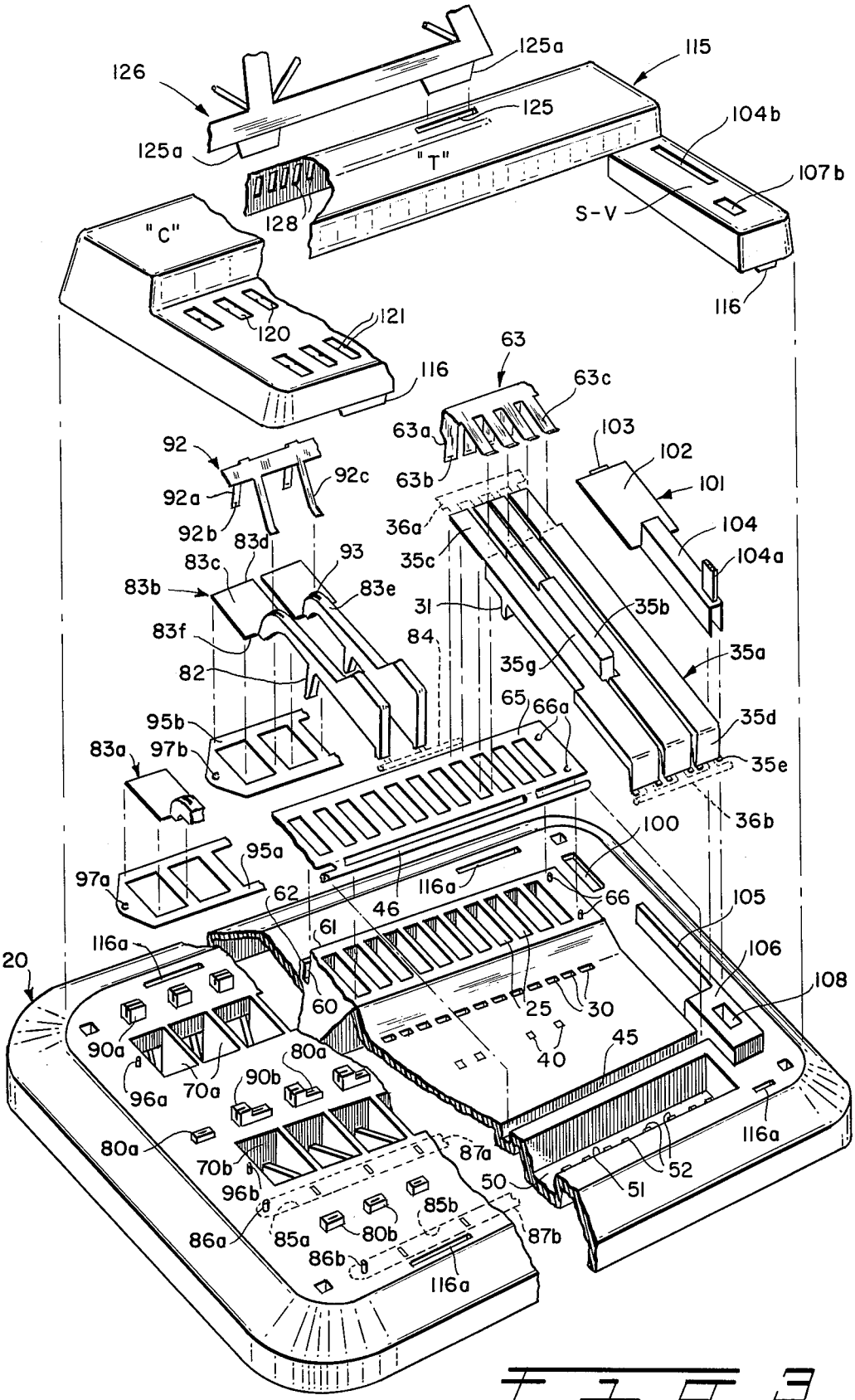
FIG. 3 is a cut-away portion of an exploded view of the upper surface of the upper chamber portion and cabinet top.

FIGS. 1, 2 and 3 depict a molded cabinet central plate, hereinafter referred to as an upper chamber portion 20, provided with an inner peripheral ledge 21 on its bottom surface which is complementary with and capable of being joined to periphery 21*a* of lower chamber portion 10. The bottom surface of upper chamber 20 is provided with a plurality of posts 16*a*—16*a* which are arranged such that each is capable of being snugly inserted into its respective socket 16 when the upper and lower chamber portions are joined. Preferably the free ends of each post are tapered to facilitate their insertion into the sockets, some of the posts having a ledge 23 for seating with the top surface of its respective socket.

As seen in FIGS. 2 and 5, also located on the bottom surface of upper chamber portion 20 is a motor mount 24 for receiving a motor 24*a*, said mount being provided with a pair of posts 24*b* having openings therein for receiving screws 24*c* for connecting the motor thereto. Motor 24*a* is provided with a flat 24*d* for receiving an impeller 24*e* or similar air moving means thereon for drawing air through air intake passage 18, when the upper and lower chamber portions are joined to provide a pressurized air chamber. A locking washer nut 24*f* is located at the end of shaft 24*d* to secure the impeller thereto.

On one section, generally referred to at "T" of upper chamber portion 20, as seen in FIG. 3, a plurality of aligned treble openings 25—25 are provided, the number of openings corresponding to the number of treble tones desired to be emitted from the formed organ. In the preferred embodiment of this invention, a three octave organ is depicted. Each of the openings extend through upper chamber portion 20 into formed passageways 26—26 and form a comb 27*a* on the bottom surface of the upper chamber portion. A molded elongated plastic reed plate 27 having a peripheral configuration similar to the contour of the free ends of comb 27*a* is adhered thereto by a suitable plastic bonding agent, such as toluol, said reed plate having a plurality of reeds or tongues 29—29 thereon of varying size for permitting desired tones to be produced, as described hereinafter. Each reed or tongue 29 is located on reed plate 27 such that it communicates with its respective reed passageway 26 when the reed plate is connected to comb 27*a*.

Figure 6:
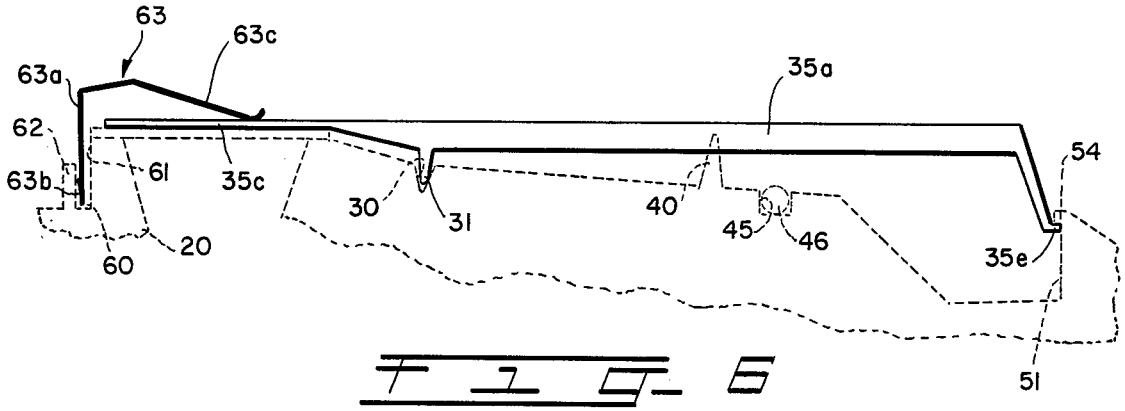
FIG. 6 is a side view of a treble key, and a partial cross-sectional view of the upper chamber portion.

Located behind treble openings 25—25, as seen in FIGS. 3 and 6, are a plurality of aligned nests 30—30, each nest being located directly behind its respective opening 25 for receiving a pivotal member 31 extending from the bottom surface of each natural key 35*a* and sharp-flat key 35*b* of a keyboard generally referred to at 35 and described hereinafter.

Located directly behind the aligned nests 30—30 of each sharp-flat key 35*b* are a plurality of aligned projecting key locators 40—40 for receiving a hollowed-out bottom portion of each sharp-flat key which is formed by side walls 35*g*, thereby minimizing any lateral movement of the keys when the keyboard is assembled therewith. Located behind key locators 40—40 is an elongated horizontally extending nest 45 disposed in parallel relationship with aligned openings 25—25, nest 30—30 and key locators 40—40, said nest 45 being provided to receive an elongated annular, plastic anticlatter strip 46 therein. Strip 46 projects upwardly from its nest a sufficient distance to limit the travel of a key which is depressed and, further, cushions any noise which would result when the bottom surface of the key engages the strip. Finally, nest 50 extends horizontally behind locators 40—40 for providing a travel space for keys 35*a*, when same are depressed during play. A separation 51 is formed for each natural key depressing end 35*d* by a plurality of vertical projecting walls 52, thereby minimizing any lateral movement of the keys. Further, as seen in FIG. 6, an overhead flange 54 extends horizontally along the top surface of separation 51 for contact by nibs 35*e* extending from the bottom of each key, said nib contact preventing each key from being withdrawn from its respective separation after assembly and further to provide an up-stop for the keys so as to maintain them in a single plane, thereby resulting in a uniform pressure being applied thereto, as later described. Typically, the nest wall of each separation 51 is contoured similarly to the shape of the key end located therein.

As seen in FIGS. 2 and 6, located in front of the aligned openings 25—25 are a plurality of slots 60—60 formed by a housing wall 61 of said aligned openings and a plurality of vertically extending members 62—62 projecting from the top surface of upper chamber portion 20. The slots are of such a width to snugly receive vertical leg portions 63*a* of a horizontally extending spring strip body 63, each leg portion having a pierced nib 63*b* which is resiliently wedged between housing wall 61 and members 62—62 for securely holding the spring strip body. A plurality of fingers 63*c* extend angularly from the spring strip body, the free ends of each finger being slightly bent angularly upwards and in contact with each key for relative sliding movement therewith. Each of the fingers 63*c* extend downwardly from spring strip body 63 such that a predetermined force is urged on each key pallet 35*c* to securely hold the key against a unitary gasket 65 which envelops reed openings 25—25, thereby closing the reed openings when the keys are in a normally rest position and preventing any note from being unwantedly sounded. A pair of posts 66—66 are located at the opposing far ends of the aligned openings housing for receiving openings 66a—66a in the gasket so as to hold the gasket after it is stretched and applied over the openings uniformly. The gasket is made from a plastic material and of a uniform thickness which serves not only as an "anti-clatter" device for preventing noise when the key pallets make contact therewith during play but may also serve as a sealant for preventing any unwanted escape of air from the air chamber to be formed.

Positioned on another section generally referred to at "C", of the top surface of upper chamber portion 20, is a first row 70a—70a and a second row 70b—70b of aligned chord openings extending horizontally in parallel relationship to each other, the first row of chord openings 70a corresponding to the number of major tones to be produced by the organ, and the second row of chord openings 70b corresponding to the number of minor tones to be produced by the formed organ. It should be noted that the chord openings 70b are alternately located between the openings 70a for reasons which shall become apparent. In the preferred embodiment, a 16 chord organ (8 major tones-8 minor tones) is illustrated. Each of the openings 70a—70a and 70b—70b extend through the chamber into formed passageways 71a—71a and 71b—71b to form respective combs 72a and 72b on the bottom surface of upper chamber 20. Elongated molded plastic reed plates 73a and 73b, each having a peripheral configuration similar to the contour of the free ends of its respective combs 72a and 72b are adhered thereto by a suitable bonding agent, said reed plates each having a plurality of reeds or tongues 74a—74a and 84b—74b thereon of varying size for permitting desired tones to be produced. Each reed or tongue is so located on its respective reed plate that it will communicate with its respective reed passageway when each reed plate is connected to its respective comb.

Respectively located behind the row of aligned chord openings 70a—70a and 70b—70b are a plurality of aligned nests 80a—80a and 80b—80b, each nest being located directly behind its respective openings 70a—70a and 70b—70b for receiving a pivotal member 82 extending from the bottom surface of each chord 83a—83a and 83b—83b of a keyboard 83. Located behind aligned chord openings 70b are a pair of slightly elevated surfaces 85a, 85b extending horizontally with respect to the chord openings and in parallel relationship therewith, said elevated surfaces each having posts 86a—86a and 86b—86b located at the far ends thereof for receiving openings of respective plastic anti-clatter strips 87a, 87b thereon, and holding said strips thereon after said strips are stretched thereover, the strips limiting the travel space of keys 83a—83a and 83b—83b and serving to cushion any noise which may result when a chord key is depressed and the bottom surface thereof contacts the strip.

Positioned in front of the aligned chord openings 70a—70a and 70b—70b are a plurality of aligned slots 90a—90a and 90b—90b, each slot being formed by a pair of opposing vertical walls. Preferably, slots 90b—90b are integrally connected to slots 80a—80a. The slots are of such a width to snugly receive vertical leg portions 92a of respective horizontally extending spring strip bodies 92—92, one strip body serving the keys of openings 70a—70a and the other strip body serving the keys of openings 70b—70b. Each leg portion 92a is provided with a pierced nib 92b which is resiliently wedged between walls 91—91 for securely holding the spring body. A plurality of fingers 92c—92c angularly extend from each strip body, the free ends of each finger being slightly bent upwards for receipt in a respective cavity 93 disposed on each key. The fingers 92c extend downwardly from each spring strip body 92 such that a predetermined force is urged on each key pallet 83b to securely hold the key against respective gaskets 95a, 95b, similar in structure and function to gasket 65, which envelop chord openings 70a—70a and 70b—70b. As a result, the chord openings are closed when the keys are in a normally rest position, thereby preventing any notes to be unwantedly sounded. A pair of posts 96a—96a and 96b—96b are respectively located at the opposing far ends of each of the rows of aligned openings 70a—70a and 70b—70b for receiving openings 97a—97a and 97b—97b in the gaskets to hold each gasket after it is stretched and applied over the openings during fabrication.

Figure 7:
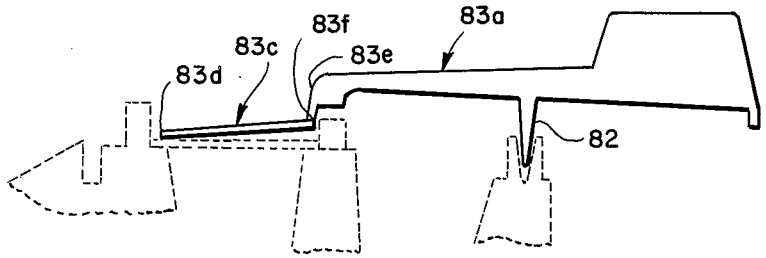
FIG. 7 is a side view of a chord key before connection to a resilient strip body, and a partial cross-sectional view of the upper chamber portion; and, FIG. 8 is a side view of a chord key after connection to a resilient strip body, and a partial cross-sectional view of the upper chamber portion.
Figure 8:
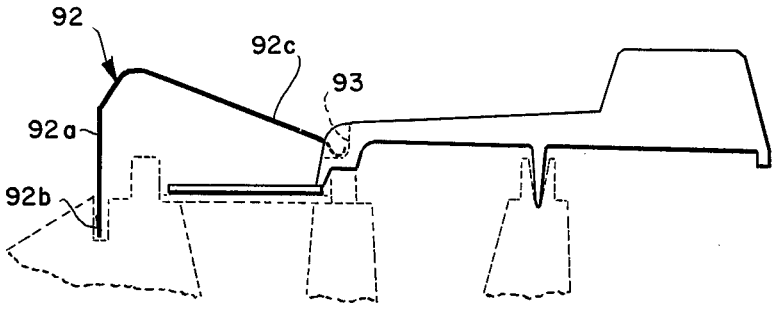

The pallets 83c of each chord key preferably are formed such that the far or free end 83d thereof extends angularly downwards from its key body portion 83e located adjacent to spring finger receiving cavity 93. As such, when the key initially is presented to its respective chord opening during fabrication, as seen in FIG. 7, the key pallet free end 83d contacts the gasket and, when spring finger 92c is applied to its respective finger receiving cavity 93 and the spring strip body is properly positioned, the force exerted by the finger upon the cavity causes pallet end 83d to progressively deform until its near end 83f contacts and is seated with the gasket, thereby positively holding the entire pallet in a closed position, as seen in FIG. 8. Further, it should now be apparent that since the far end of the pallet makes initial contact with the housing openings and spring finger 92c is located in key receiving cavity located over the near end of the pallet, a full sealing of the openings from the free end of the pallet to the near end thereof is insured. Also, cavity 93 serves as a locator for each key, thereby preventing any lateral movement and maintaining key alignment.

It is to be understood thus far that while a 16 chord organ comprised of two rows of keys each having eight keys in number, have been described, numerous other arrangements, such as a single row of keys comprising one octave or four or more rows of keys each containing an octave, may be located upon upper chamber portion 20 without departing from the scope of this invention. Also, if desired, the treble key pallets may be constructed in a manner similar to that of the chord key pallets.

Located on another section of the top surface of upper chamber portion 20 is an elongated slot 100 which extends through the body of the chamber portion. A volume control lever, generally referred to at 101, is provided with a closure member 102 having a hooking element 103 projecting downwardly from its free end, an inverted substantially U-shaped body 104 connected to and projecting upwardly from its other end, and a knob 104a extending from the body for manipulating the lever. In assembly, hooking element 103, having a width greater than the width of slot 100, is presented to and located within said slot at a substantially right angle thereto, whereupon the lever body then is moved approximately 90° and the inverted U-shaped body is raised over and then dropped onto an elevated track 105. As a result, upon grasping and moving knob 104*a*, the lever body is movable to and fro over track 105, thereby resulting in closure member 102 traveling to and fro over slot 100 for opening and closing same to control the passage of pressurized air therethrough and, in turn, the volume of the tones to be emitted from the organ.

Located behind track 105 is a small raised housing 106 provided with posts 106*a*—106*a* thereunder for receiving a switching means 107 (FIG. 2) thereon, said housing having an opening 108 through which a switch actuator 107*a* extends above the top surface of upper chamber portion 20. Switching means 107 is connected to cord 14 having a plug 110 for connection to an electrical outlet source, and also is connected by line 110 to motor 24*a* for driving impeller 24*e*.

The final major molded portion of the organ is a cabinet top, generally referred to at 115 and seen in FIGS. 1 and 3, which is capable of being quickly connected to upper chamber portion 20 by a number of tapered tabs 116—116 extending downwardly from the bottom periphery thereof for their snug-wedged insertion into respective complementary recesses 116*a*—116*a* located on the top surface of upper chamber portion 20. Upon the locating of tabs 116—116 into recesses 116*a*—116*a*, the cabinet top is positioned such that a housing section "T" covers the treble natural and sharp-flat key pallets; another housing section "C" covers the chord key pallets, and also is provided with two rows of aligned openings 120—120 for receiving the elevated finger depressing portions 83*g* of chord keys 83*a* therein, each of said openings being provided with a pair of opposing nibs 121—121 projecting from opposing lateral surfaces thereof to provide a lateral stabilization of each chord key, that is, the opposing nibs minimize any lateral movement of each chord key located therebetween; and, another housing section "S-V" is provided with slots 104*b* and 107*b* for receiving volume control knob 104*a* and switch actuator 107*a*, respectively. The cabinet top 115 also is provided with a plurality of slots 125—125 for receiving tapered tabs 125*a*—125*a* of a molded music rack 126, said tabs capable of being wedgedly inserted into their respective openings for securely supporting the rack. A plurality of removable sealed vents 128—128 are provided on the rear lateral surface of the cabinet top for permitting any desired pressurized air to escape from the chamber so as to control the overall volume intensity of the organ.

Prior to describing the method of assemblinh the aforesaid components into an organ, a further description as to the formation and number of the components is deemed essential. Firstly, the major molded components include lower chamber portion 10, upper chamber portion 20 and cabinet top 115, the aforesaid components being respectively cooperatively associated with an individual unitary molded treble reed plate 27, chord reed plates 73*a*, 73*b* and volume control lever 101. Secondly, the keys of the treble keyboard 35, as seen in FIG. 3 are integrally molded with horizontally extending runners 36*a* and 36*b* respectively joined to the pallet end of each natural and sharpflat key, and to the finger depressing end of each natural key only for holding said keys intact in their final desired spacial relationship and in their proper required order during the assembly of the organ; similarly, each row of keys of the chord keyboard 83, as seen in FIG. 3, are integrally molded with a horizontally extending runner 84 which is attached to the finger depressing end of each key. Preferably prior to assembly, the treble sharp-flat keys may be provided with a desired color or design by applying the intact runner-keyboard to either a conventional hot-stamping machine whereat the elevated sharp-flat keys are contacted by a conventional hot-stamping machine or a painting apparatus wherein the sharp-flat keys are caused to be in contact therewith for reviewing the desired color of paint thereon. Thirdly, treble spring bodies 63 and chord spring strip bodies 92—92 each are of a unitary structure and, while such spring strip bodies are depicted as metallic, it should be noted that molded plastic spring strip bodies may be utilized. Preferably, the spring strip bodies are segmentally taken from a continuous punched strip, to serve any desired number or octaves of keys. Fourthly, treble gasket 65, chord gaskets 95*a*, 95*b* and anti-clatter strips 46 and 87*a*, 87*b* are produced from a single mold and easily removable therefrom. Finally, a conventional switching means 107 and motor driven impeller 24*e* are utilized.

In assembling the organ, the upper chamber portion 20 is inverted to subject the formed passageway's housing combs 27*a*, 72*a* and 72*b* to a bonding agent thereon. Reed plates 27, 73*a* and 73*b* are applied to their respective comb surfaces 27, 72*a* and 72*b*, and preferably are temporarily clamped thereto for a few seconds. The clamps are then removed from the reed plates, and motor 24*a* is located in motor mount 24 and connected thereto. The switching means 107 having openings thereon are inserted over posts 106*a*, which are then deformed by any suitable deforming means for locking the switching means thereto and thus securing it to the bottom surface of the upper chamber portion.

The upper chamber portion 20 then is returned to its normally exposed position whereupon plastic anti-clatter strip 46 is inserted into its nest, and gaskets 65, 95*a*, 95*b* and anti-clatter strips 87*a*, 87*b* are stretched over their respective surfaces and posts and inserted thereover. The molded intact treble keyboard with the runners 36*a*, 36*b* thereon is inverted and located over its treble section whereupon an operator quickly removes runner 36*b* from the finger depressing ends of the keys by inserting the runner within a device (not shown) having an elongated recessed means which is moved to and fro to snap the runner from the keys. The keyboard is returned over to its normal side and positioned on the top surface of upper chamber portion 20 such that simultaneously all the finger depressing ends of the keys are located in their respective separations 51—51, key pallet ends 35*c*—35*c* are located over their respective openings 25—25 and key pivotal members 31—31 are located in their nests 30—30. Key runner 36*a* is quickly removed in a manner similarly to runner 36*b*, that is, the runner is inserted into a device (not shown) having an elongated recessed means which is moved to and fro to snap the runner from the keys, whereupon the leg portions 63*a*—63*a* of treble spring strip body 63 are then snugly pressed into their respective slots 60—60 and their respective fingers 63*c* engage their respective key pallets to provide the necessary spring action thereon for play. Similarly, the keys of the minor chord keyboard are located over the minor or second row of openings 70*b*—70*b* and its respective nests 80*b*—80*b* the major chord keyboard are located over the major or first row of openings 70*a*—70*a* and its respective nests 80*a*—80*a* for receiving key pivotal members 82. The leg portions 92*a* of spring strip body then are pressed into their respective slots 90*a*—90*a*, and the spring fingers are located in their respective finger receiving cavities 93 on the major keys. Runner 84 is then removed from the keys of the chord major keyboard. A spring strip body 92 is similarly connected to the keys of the minor keyboard, whereupon its runner 84 then is removed therefrom.

Next, impeller 24*e* is located over shaft flat 24*d* and secured thereto by lock-nut 24*f*. All the posts of the upper chamber portion then are aligned with their respective sockets in the lower chamber portion, whereupon the two chamber portions are pressed and joined together to form a chamber or plenum for containing pressurized air produced by the motor impeller unit. Volume control lever 101 is connected to upper chamber portion 20, as previously described, and, tabs 116—116 of cabinet top 115 are inserted into upper chamber portion recesses 116*a*—116*a* to finalize the assembly of the organ. As a result of the foregoing structure and assembly, an improved chord organ is formed cheaply and quickly which uniquely results in a minimal of air loss, a reduction in power and a decrease in sealing criticality.

We claim:

1. In the manufacture of a musical keyboard which comprises:

a plurality of natural and sharp-flat keys molded in a predetermined spacial relationship with respect to each other, and one removably connected runner integrally molded to and extending along the pallet end of each natural and sharp-flat key, and another removably connected runner integrally molded to and extending along the finger depressing end of each natural key, said runners holding the keys in said predetermined spacial relationship.

2. In the manufacture of a musical keyboard, a musical keyboard, according to claim 1, wherein the keys are arranged in their desired tonal sequence for connection to said musical instrument.

3. In the manufacture of a musical keyboard, a musical keyboard, according to claim 2, wherein the sharp-flat keys are color coded responsive to a coding apparatus.

4. In the manufacture of a musical keyboard, a musical keyboard, according to claim 3, wherein the sharp-flat keys are provided with a hot stamp marking thereon.

* * * * *